US006101631A

United States Patent [19]

Ferguson, Jr.

[11] Patent Number: 6,101,631

[45] Date of Patent: Aug. 15, 2000

[54] BUILT-IN FULL-BODY HARNESS SYSTEM FOR HUNTERS

[76] Inventor: Vernon Ferguson, Jr., 1316 Telegraph Rd, Coatesville, Pa. 19320

[21] Appl. No.: 09/324,041

[22] Filed: Jun. 2, 1999

[51] Int. Cl.[7] ..... A62B 35/00

[52] U.S. Cl. ..... 2/94; 2/108; 182/3; 244/151 R

[58] Field of Search ..... 2/69, 79, 81, 93, 2/108, 92, 44, 94, 97, 456, 307–310, 312, 69.5, 70; 182/3–6, 11; 244/151 R, 138 R, 142–143

[56] References Cited

U.S. PATENT DOCUMENTS

| | | | |
|---|---|---|---|
| 1,845,099 | 2/1932 | Burianova | 244/151 R |
| 2,979,153 | 4/1961 | Hoagland et al. | 182/3 |
| 3,424,134 | 1/1969 | Rosenblum | 119/96 |
| 3,701,395 | 10/1972 | Theobald | 182/3 |
| 4,177,877 | 12/1979 | Gallinati | 182/3 |
| 4,273,216 | 6/1981 | Weissmann | 182/3 |
| 4,731,882 | 3/1988 | Ekman | 2/69 |
| 5,136,724 | 8/1992 | Grilliot et al. . | |
| 5,220,976 | 6/1993 | Gunter | 182/3 |
| 5,289,590 | 3/1994 | Larson . | |
| 5,450,627 | 9/1995 | Grilliot et al. . | |
| 5,738,046 | 4/1998 | Williams et al. . | |
| 5,806,095 | 9/1998 | Cotten . | |
| 5,960,480 | 10/1999 | Neustater et al. | 2/456 |
| 5,970,517 | 10/1999 | Jordan | 2/69 |

*Primary Examiner*—John J. Calvert
*Assistant Examiner*—Tejash Patel
*Attorney, Agent, or Firm*—Henderson & Sturm LLP

[57] ABSTRACT

A built-in full-body harness system 10 for hunters including a full-body harness member 20 having a pair of adjustable length upper body strap members 21, 22 which are connected to a bracket element 23 having a D-ring element 24, an adjustable length chest strap member 26 and an elongated lower body strap member 31 connected to the upper body strap members 21, 22 which are slidably received in internal passageways 53 formed in an outerwear unit 12 such that the full-body harness member 20 is suspended within the outerwear unit 12.

1 Claim, 5 Drawing Sheets

BUILT-IN FULL-BODY HARNESS SYSTEM FOR HUNTERS

BACKGROUND OF THE INVENTION

1. Field of the Invention

The present invention relates to the field of body harnesses in general and in particular to a full-body harness that is built into an article of camouflage clothing.

2. Description of Related Art

As can be seen by reference to the following U.S. Pat. Nos. 5,738,046; 5,136,724; 5,289,590; 5,450,627; 5,806,095; the prior art is replete with both upper body harnesses built into jackets and lower body harnesses built into pants for the purpose of suspending the wearer at elevated locations.

While all of the aforementioned prior art constructions are more than adequate for the basic purpose and function for which they have been specifically designed, they are uniformly deficient with respect to their failure to provide a simple, efficient, and practical full-body harness that can be built into an article of camouflage clothing or work clothing.

As virtually all hunters that use elevated tree stands and platforms are all too well aware, the leading cause of death and serious injury to hunters is not being shot by other hunters but rather falling out of an elevated portable or permanent tree stand or the like.

In addition, current research has indicated that while both upper torso and lower torso harnesses will prevent a hunter from dropping from a great height, they are also fraught with their own unique problems.

For instance, an upper torso harness will maintain the hunter in an upright position; however, in the absence of lower torso support, the upper body harness will compress the hunters diaphragm rendering the hunter unconscious in a relatively short period of time.

On the other hand, while the lower torso harness will not directly compress the user's diaphragm, the hunter will be suspended from the tree in an upside down position that is not only extremely difficult for the hunter to regain an upright position from; but, which also forces all of the hunters blood towards their head which will ultimately render the hunter unconscious.

Furthermore, while most hunters acknowledge that the full-body harness is by far the safest and most secure system for preventing dire consequences from arising due to a fall from a tree stand, this system also has some drawbacks that up until the present time have retarded the widespread acceptance of the full-body harness by many hunters.

To begin with, virtually all full-body harnesses are designed to be worn on the outside of the hunter's outerwear which exposes a large amount of harness strap surface to be potentially exposed to snagging on brush, branches, cut tree limbs, tree steps and/or equipment. However, by far the greatest cause for resistance on the hunter's part is the fact that there are so many loops and straps involved in the full-body harness that have a tendency to become twisted and entangled with one another that the hunter does not want to be bothered untangling the looped straps each time that they don the device; and, this situation is further exacerbated during morning hunts when the hunter is attempting to put on the full-body harness wither in the dark or with the aid of a flashlight or vehicle headlights.

As a consequence of the foregoing situation, there has existed a longstanding need among hunters for a new and improved full-body harness that is built into a hunter's camouflaged outerwear; and, the provision of such an arrangement is the stated objective of the present invention.

BRIEF SUMMARY OF THE INVENTION

Briefly stated, the built-in, full-body harness system for hunters that forms the basis of the present invention comprises in general, a full-body harness unit and an outerwear unit that incorporates the full-body harness unit therein.

As will be explained in greater detail further on in the specification, the outerwear unit may comprise an oversized full body camouflaged one-piece suit member or a jacket member. In the first instance, the full-body harness unit is completely contained within the one-piece suit member and in the second instance, the upper portion of the full-body harness unit is contained within the jacket member and the lower portion of the full-body harness unit is suspended from the jacket member. This way the hunter only needs to connect the leg loops of the lower portion of the harness unit which are suspended from the jacket member and then adjust the strap members and engage the clasps that are associated with the full-body harness unit.

In addition, in both versions of the preferred embodiment, only the D-ring element on the upper portion of the harness unit is exposed and then the exposure only occurs during the time that the hunter is actually occupying the tree stand.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
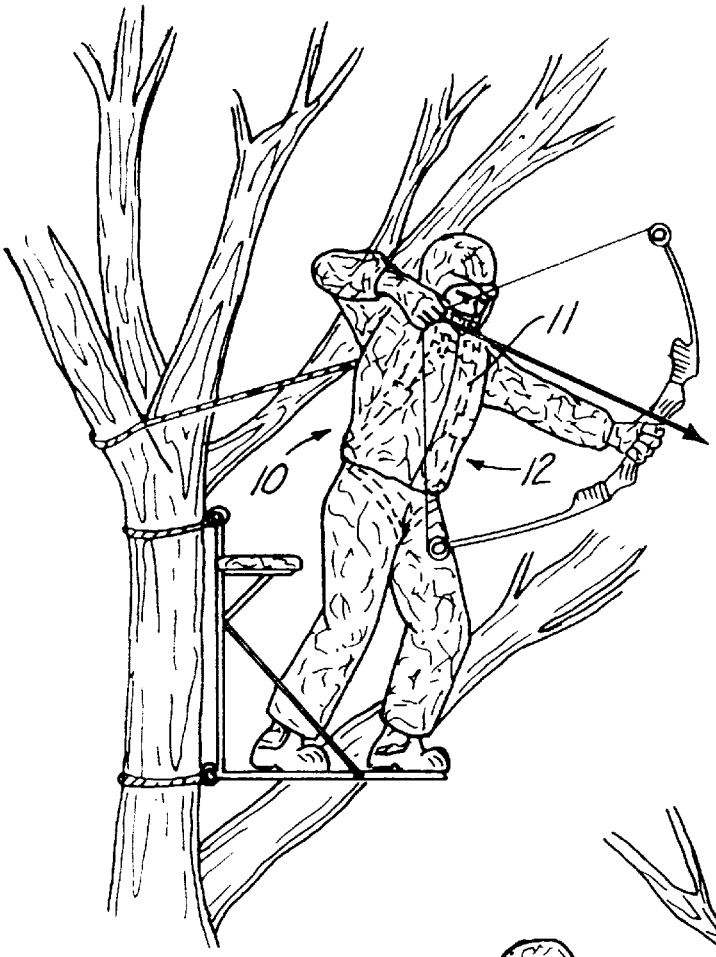
FIG. 1 is a perspective view showing the built-in harness system being employed by a bow hunter.
Figure 2:
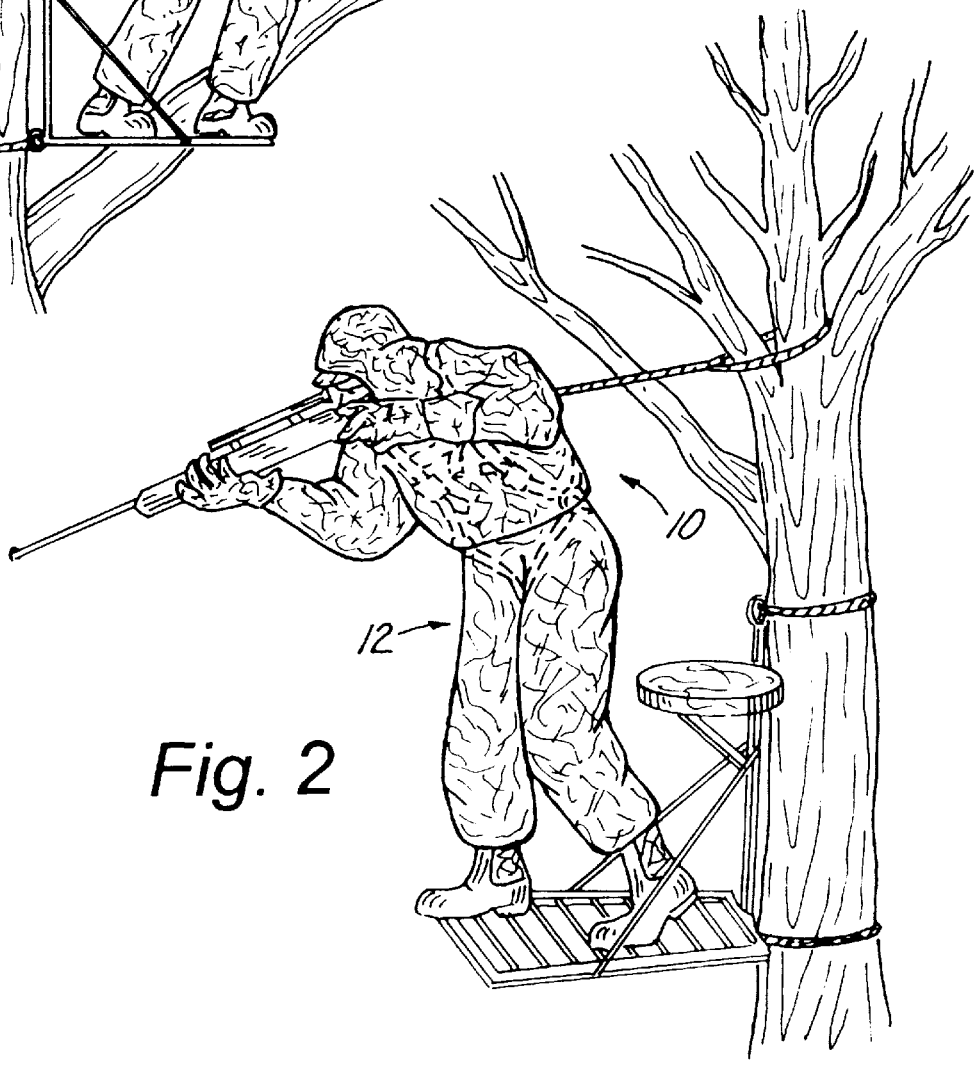
FIG. 2 is a perspective view showing the harness systems being employed by a gun hunter.

As can be seen by reference to the drawings, and in particular to FIG. 1, the built-in, full-body harness system for hunters that forms the basis of the present invention is designated generally by the reference number 10. The system 10 comprises in general a full-body harness unit 11 and an outerwear unit 12. These units will now be described in seriatim fashion.

Figure 3:
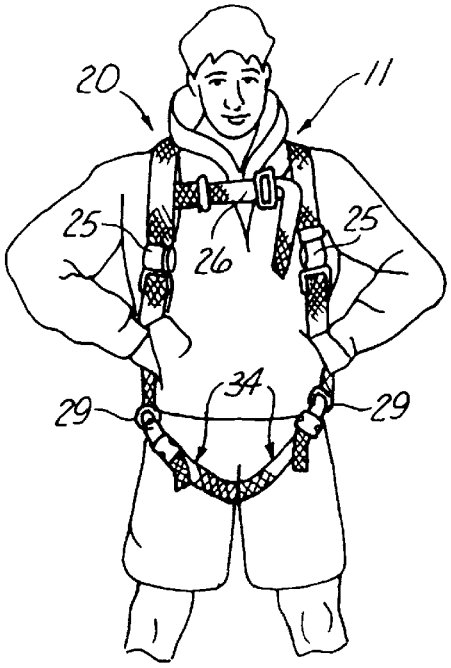
FIG. 3 is an isolated front perspective view of the full-body harness unit that forms part of this invention.
Figure 4:
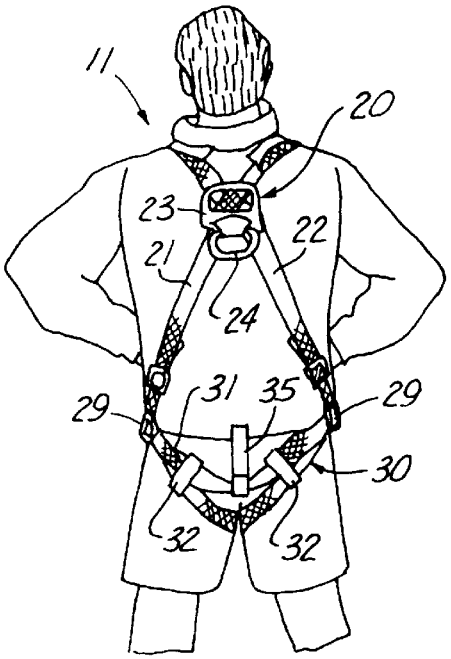
FIG. 4 is an isolated rear perspective view of the full-body harness unit that forms part of this invention.
Figure 9:
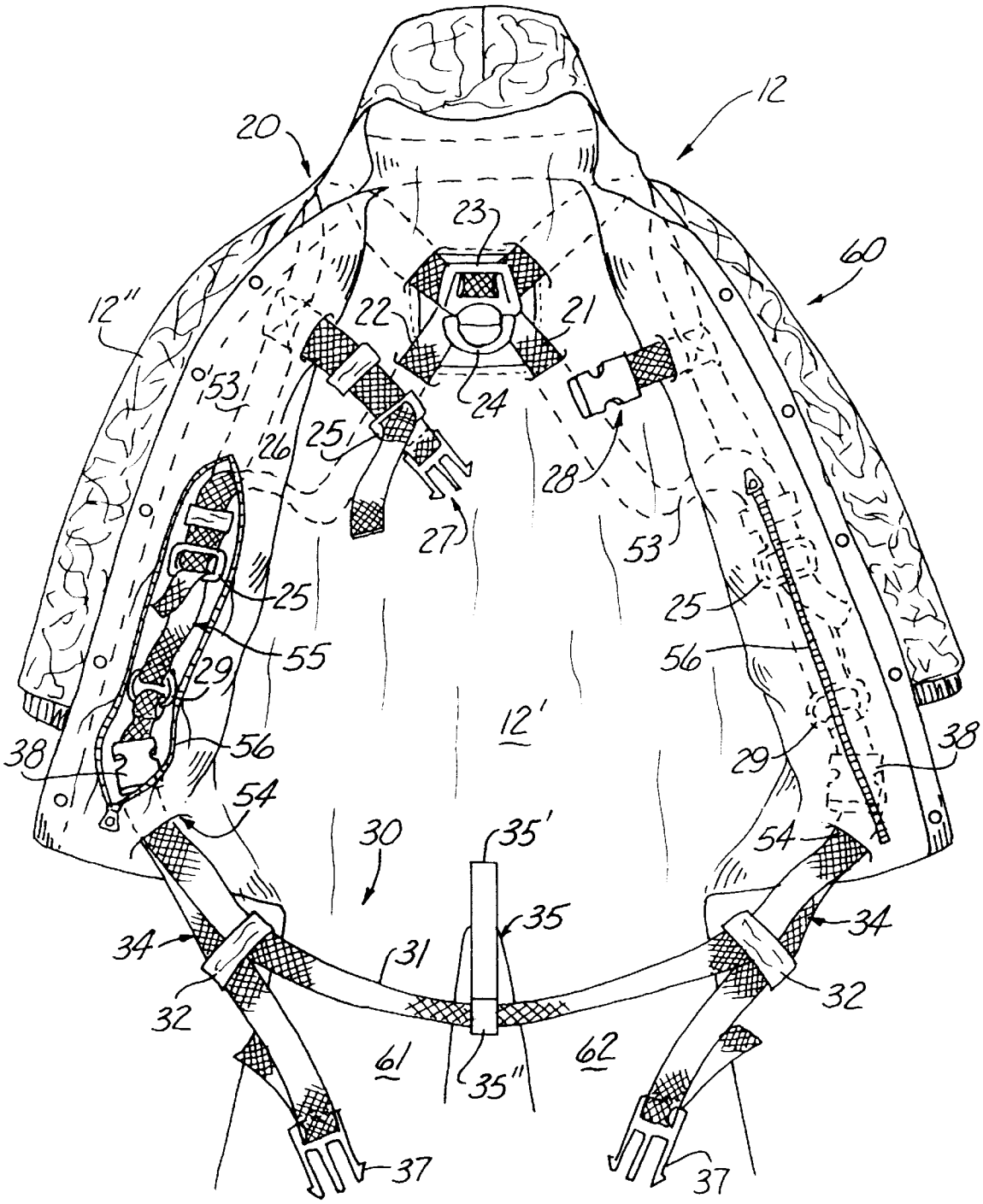
FIG. 9 is an interior view of the full-body harness unit deployed in one version of the outerwear unit.

As can best be seen by reference to FIGS. 3, 4, and 9, the full-body harness unit 11 comprises a full-body harness member 20 having a pair of relatively elongated upper body strap members 21, 22 which pass in a crisscross fashion through a bracket element 23 provided with an enlarged pivoted D-ring element 24; wherein, the bracket 23 and the D-ring element 24 are disposed on the upper rear portion of the full-body harness member 20 at a point proximate the user's shoulder blades.

As shown in FIGS. 3, 4, and 9, the front portion of the upper body strap members 21, 22 are provided with strap adjustment elements 25 to vary the length of the upper body strap members 21, 22 in a well-recognized fashion to accommodate hunters having different trunk lengths.

In addition, at least one of the upper body strap members 21 of the full-body harness member 20 is provided with at least one adjustable length horizontal chest strap member 26 provided with another strap adjustment element and a bayonet clip 27 wherein the other upper body strap member 22 of the full-body harness member 20 is provided with a quick release clasp element 28 that is adapted to receive and releasably engage the chest strap member 26 in a well-recognized manner.

Still referring to FIGS. 3, 4, and 9, it can be seen that the full-body harness member 20 further includes a lower body strap assembly designated generally as 30 which includes an elongated lower body strap member 31 which passes through a pair of smaller D-ring elements 29 that join the opposite ends of the two upper body strap members 21, 22 together as well as form the operative connection between the upper body strap members 21, 22 to the lower body strap assembly 30.

In addition, as shown in FIGS. 4 and 9, the lower body strap member 31 is provided with a pair of guide loops 32 which maintain the upper portion 33 of the body strap member 31 adjacent to the lower portion 34 of the body strap member 31; wherein, the upper portion 33 of the body strap member 31 is provided with a looped tether element 35 whose purpose and function will be explained in greater detail further on in the specification.

As can best be seen by reference to FIG. 9, the ends of the lower body strap member 31 are provided with bayonet style clips 37 which are adapted to engage quick release clasp 38 to produce leg encircling loops that will surround and support the user's thighs in a well-recognized fashion.

Figure 6:
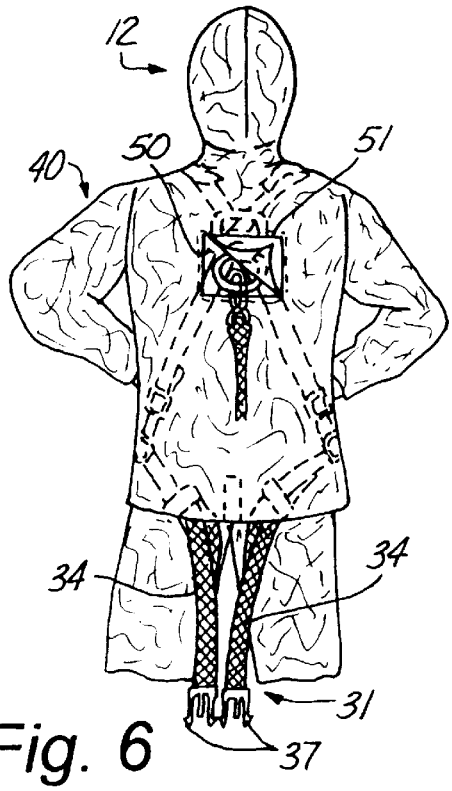
FIG. 6 is a rear perspective view of the jacket version of the preferred embodiment.
Figure 8:
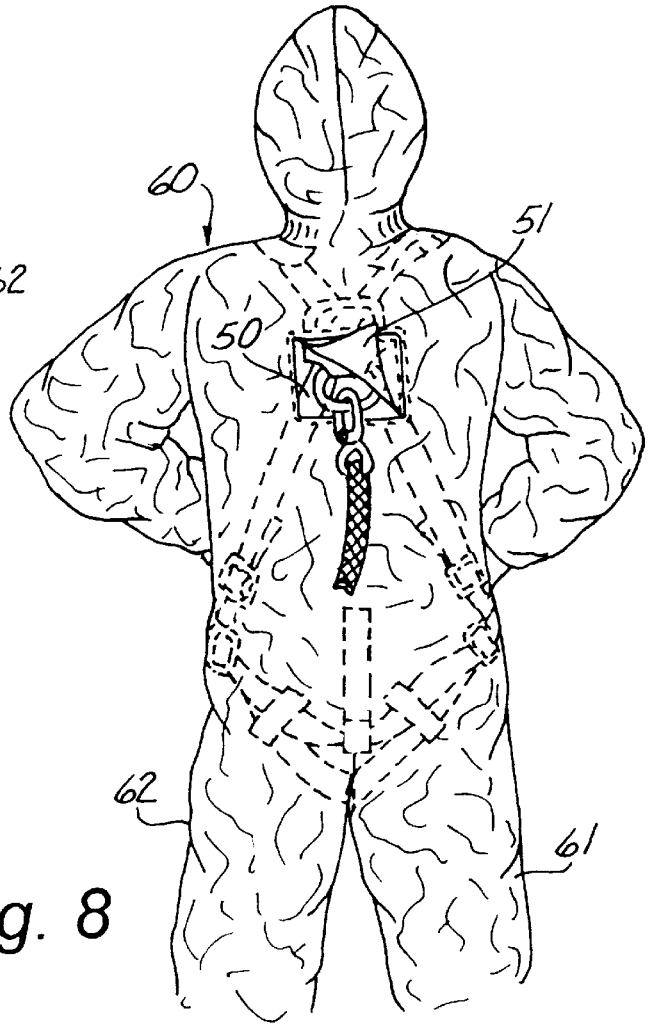
FIG. 8 is a rear perspective view of the one-piece, full-body suit version of the preferred embodiment.
Figure 10:
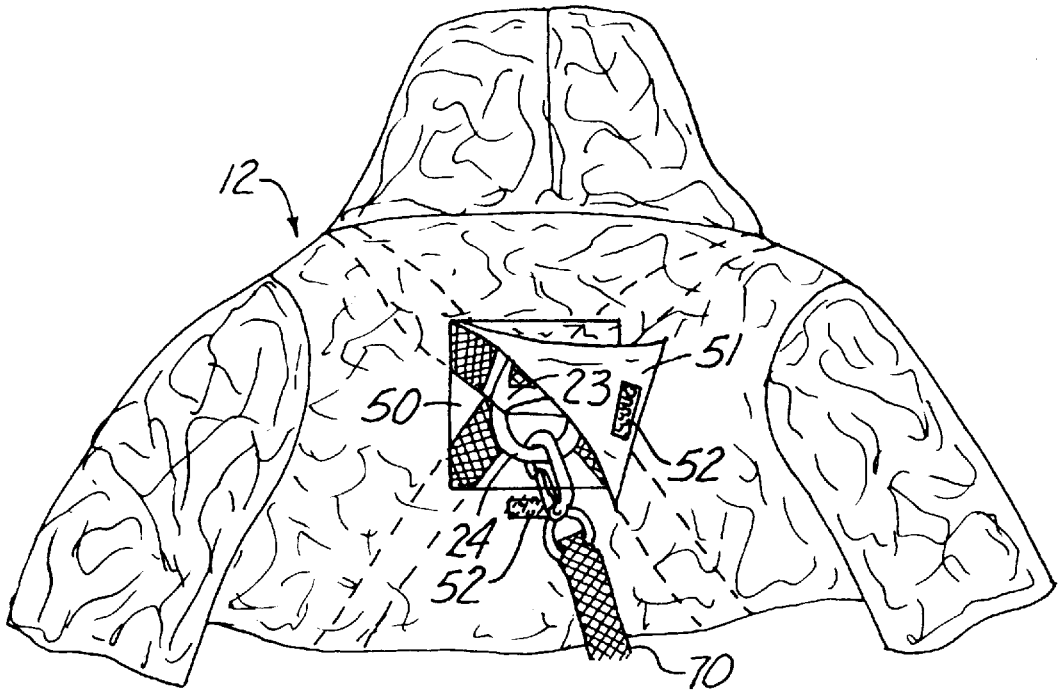
FIG. 10 is an isolated detail view of the D-ring placement on the back of the outerwear unit.
Figure 11:
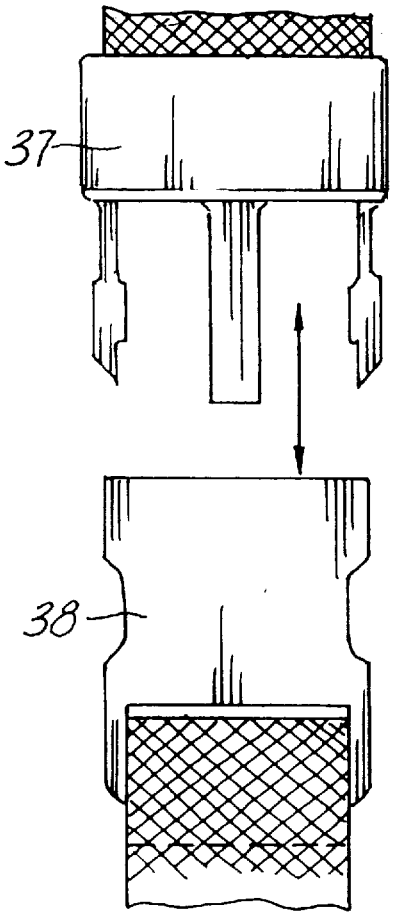
FIG. 11 is an isolated detail view of the quick-release clasp elements that are envisioned for use in this system; and, FIG. 12 is a cross-sectional view showing the exterior flap arrangement that permits the strap elements that are disposed within the outerwear unit to be adjusted.
Figure 12:
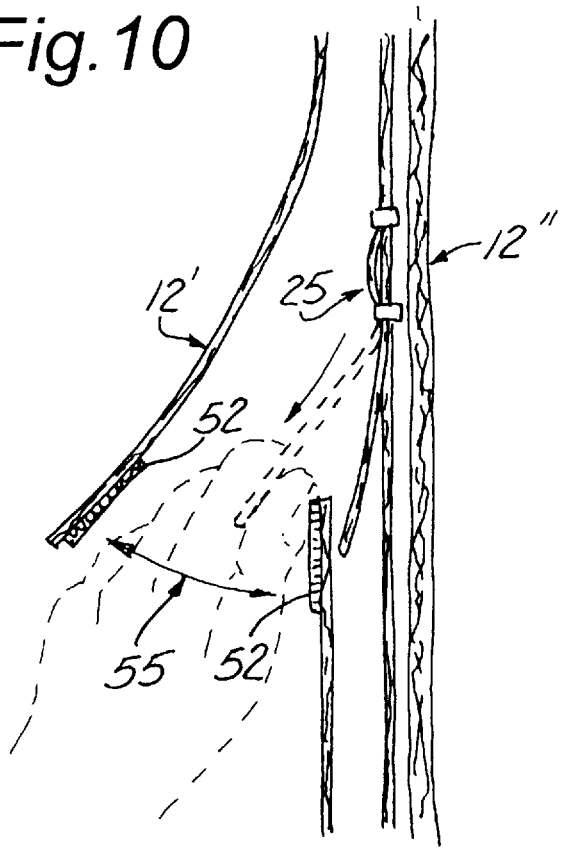

As was mentioned previously in the specification and is depicted in FIGS. 6, 8 and 10, the outerwear unit 12 may comprise either a jacket member 40 or a one-piece body suit member 60 wherein both the jacket member 40 and the body suit member 60 contain common structural features such as an enlarged upper back opening 50 disposed adjacent to the bracket element 23 and the enlarged D-ring element 24 of the full-body harness member 20; wherein, the back opening 50 is provided with a hinged panel element 51 wherein both the hinged panel element 51 and the back of the outerwear unit 12 are provided with cooperating hook and loop fasteners 52.

As can also be seen by reference to FIG. 10, the hinged panel element 61 covers the enlarged D-ring element 24 until the hunter climbs into a tree stand and attaches a safety belt tether 70 to the D-ring element 24 of the full-body harness member 20 in a well-recognized fashion.

Furthermore, as shown in FIG. 9, both versions of the outerwear unit 12 contain interior 12' an exterior 12" surfaces of the outerwear unit 12; wherein, the passageways 53 are dimensioned to slidably receive the full body harness member 20 and have passageway openings 54 that selectively expose portions of the full body harness member.

As shown in FIGS. 9 and 10, the interior surface 12' of the outerwear unit 12 is provided with enlarged openings 55 provided with closure elements such as zippers 56 or cooperating hook and loop fasteners 52; wherein, the closure elements 56, 52 are disposed proximate the strap adjustment elements 25 on the upper body strap members 21, 22.

As can also be seen by reference to FIG. 9, the looped tether element 35 has an upper end 35' affixed to the interior surface 12' of the outerwear unit 12 at or above the user's belt line; wherein, the lower end 35" of the looped tether element 35 captively engages the upper portion 33 of the lower body strap member 31.

Figure 5:
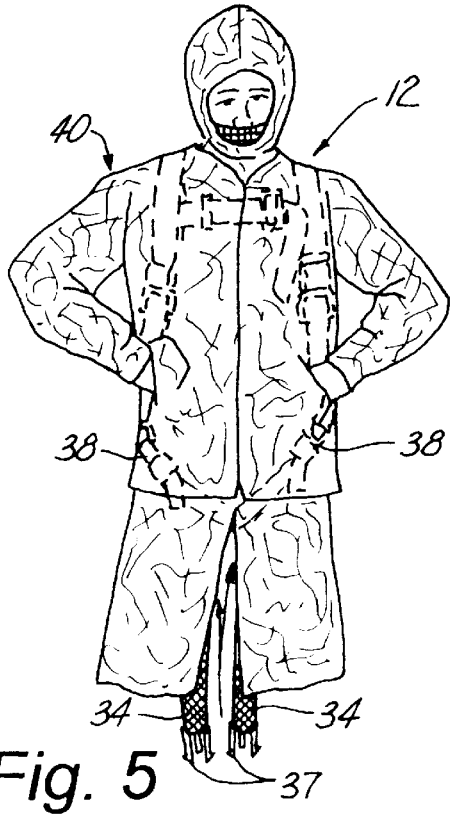
FIG. 5 is a front perspective view of the jacket version of the preferred embodiment.

Turning once more to FIGS. 5 and 6, it can be seen that in one version of the preferred embodiment the opposite ends of the lower portion 34 of the lower body strap member 31 will be suspended below the jacket member 40 until such time as the bayonet style clips 37 are drawn between the hunters legs and engaged with the quick release clasps 38 contained within the jacket member 40.

Figure 7:
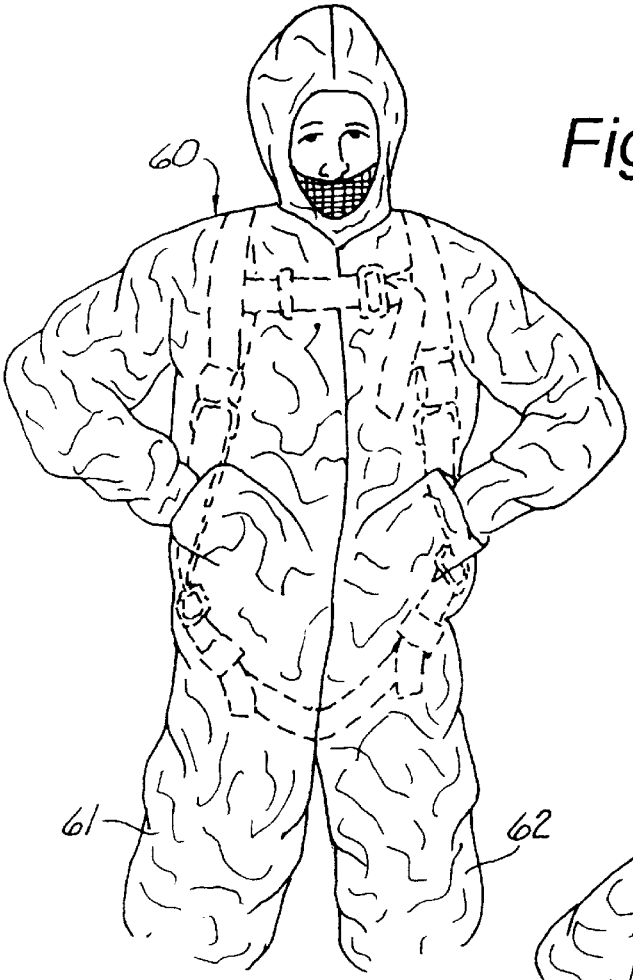
FIG. 7 is a front perspective view of the one-piece, full-body suit version of the preferred embodiment.

As can be appreciated by reference to FIGS. 7 through 9 in the union or one-piece body suit version of the preferred embodiment the body suit member 60 is provided with split leg sections 61, 62 wherein each leg section 61 and 62 is provided with conventional fasteners (not shown) which are adapted to convert each leg section 61 and 62 into a conventional pant leg when joined together after the bayonet style clips 37 have been engaged by the quick release clasps 38 and the strap adjustment elements 25 on the lower portion 34 of the lower body strap member 31.

By now it should be appreciated that in both versions of the preferred embodiment, the full body harness member 20 is partially enveloped between the inner 12' and outer 12" surfaces of the outerwear unit 12; such that the user merely has to put on the outerwear unit 12 in the normal fashion once the strap adjustment elements 25 have been previously adjusted for the user's body dimensions.

Then, once the outerwear unit 12 is in place, only three separate connections have to be completed before the wholly or partially enveloped full body harness member 20 is operatively secured in the proper fashion relative to the user's torso. Those connections being the chest strap member connection 27, 28 and the two leg strap connections 37, 38 and 37, 38 respectively.

It should also be appreciated that since the full body harness member 20 is substantially contained within the outerwear unit 12, it is virtually impossible for the various straps 21, 22, 26, and 31 from becoming twisted or entangled with one another; and, in a worst case scenario, only the leg strap portions 34 of the full body harness member 20 are ever exposed to potential snags.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A built-in full-body harness system for hunters consisting of:

a full-body harness unit including: a pair of adjustable length upper body strap members operatively associated with a bracket element equipped with an enlarged ring element; at least one adjustable chest strap member operatively and releasably associated with the pair of upper body strap members which terminate in a pair of smaller ring elements wherein each of the smaller ring elements are provided with one portion of a bayonet style clip and an elongated lower body strap member having an intermediate portion and opposite ends which are each provided with the other portion of a bayonet style clip to operatively connect the opposite ends of the lower strap members to the upper strap members wherein the lower body strap member is dimensioned to encircle both of the user's thighs; and, an outer wear unit comprising a jacket dimensioned to cover only the upper portion of a user's torso and having an outer surface and an inner surface which define internal passageways that are adapted to only receive the pair of upper body strap members and at least a portion of said at least one adjustable chest strap member; wherein, the inner surface of the jacket member is further provided with a downwardly depending tethered loop element which extends below the jacket element and is dimensioned to threadedly receive the intermediate portion of the lower body strap member.

* * * * *